US005997955A

United States Patent [19]

Pesarolo et al.

[11] Patent Number: 5,997,955

[45] Date of Patent: Dec. 7, 1999

[54] SHEET METAL SURFACE TREATMENT METHOD

[75] Inventors: Roland Pesarolo, Grans; Claude Morand, Miramas, both of France

[73] Assignee: Sollac, Puteaux, France

[21] Appl. No.: 09/091,232

[22] PCT Filed: Dec. 11, 1996

[86] PCT No.: PCT/FR96/01979

§ 371 Date: Jul. 6, 1998

§ 102(e) Date: Jul. 6, 1998

[87] PCT Pub. No.: WO97/21793

PCT Pub. Date: Jun. 19, 1997

[30] Foreign Application Priority Data

Dec. 14, 1995 [FR] France ..... 95 14834

[51] Int. Cl.[6] ..... B05D 1/38; B05D 3/02; B05D 7/14

[52] U.S. Cl. ..... 427/388.4; 427/409; 428/461

[58] Field of Search ..... 427/409, 388.4; 428/461

[56] References Cited

U.S. PATENT DOCUMENTS 4,787,995 11/1988 Nichols et al. ..... 252/49.5

FOREIGN PATENT DOCUMENTS 147265 1/1973 Czechoslovakia .
1-290778 11/1989 Japan .

*Primary Examiner*—Erma Cameron
*Attorney, Agent, or Firm*—Oblon, Spivak, McClelland, Maier & Neustadt, P.C.

[57] ABSTRACT

A process for the purpose of preparing the sheet for deep-drawing and/or protecting it against corrosion, wherein an aqueous solution of polyethoxylates of one or more lanolin derivatives is applied to the said surface, the said surface is dried to obtain a deposit in dry state, then at least one operation of oiling is performed on the deposit in dry state.

This process makes it possible in particular to simplify the operations of deep-drawing: even after prolonged storage, it is not necessary to re-oil the treated sheet just before deep-drawing.

17 Claims, 9 Drawing Sheets

SHEET METAL SURFACE TREATMENT METHOD

The invention relates to a process for treatment of the metal surface of a sheet, especially a steel sheet, for the purpose of preparing the said sheet for deep-drawing and/or protecting it against corrosion, wherein an aqueous solution of treatment product is applied to the said surface, the said surface is dried, then at least one operation of oiling of the said surface is performed.

European Patent 0 489 105 B1 describes a process of this type, wherein the treatment product comprises a water-soluble salt of an alkali metal, especially potassium phosphate.

Before a sheet is deep-drawn, therefore, a potassium phosphate solution is applied to its surface, then the applied solution is dried; the application and drying conditions are adjusted to obtain a phosphate deposit having a surface density of between 5 and 40 mg/m$^2$.

Following this deposition process, at least one operation of oiling of the surface is then performed (to cover this deposit).

When a lubricating or deep-drawing oil has been used for oiling, the sheet treated in this way is then ready to be reloaded in the forming machine (for example, a deep-drawing press).

To be effective, this surface treatment (phosphating and oiling) must be performed on a clean metal surface, and it is sometimes necessary to clean the surface of the sheet before applying the treatment solution.

Such a surface treatment in preparation for deep-drawing allows the coefficient of friction between the sheet and deep-drawing die to be reduced substantially without having to resort to oils having high additive content, because sometimes such oils must be avoided, in particular for economic reasons.

The preliminary treatment of the metal surface by a phosphate solution therefore substantially improves the tribological properties of the said surface.

The preparation of a sheet for deep-drawing therefore comprises at least two operations, one being deposition of a treatment product (phosphate) and the other oiling.

Sometimes it is necessary to arrange for not one but two oiling operations after deposition of a treatment product, because in practice the sheets are stored, sometimes for a prolonged period, longer than one month, between fabrication and forming thereof.

During this storage period, it is therefore advisable to protect the sheets against corrosion.

After deposition of a treatment product (phosphate), oiling is performed first for temporary protection against corrosion, whereas oiling for lubrication is not performed until just before forming proper of the sheet.

Protective oils are generally different from lubricating oils: in general, therefore, a single oiling operation may not be sufficient.

After storage, the sheets can therefore be deep-drawn, generally by means of a second oiling operation, or re-oiling for lubrication.

In conclusion, the following disadvantages can occur between fabrication and forming of sheets:

- at least two operations (deposition of a phosphate-based treatment product+oiling), and possibly three in the case of storage (re-oiling after storage).
- degradation of the corrosion resistance imparted by protective oiling, if this oiling operation was preceded by deposition of a phosphate-based treatment product, which reflects a problem of compatibility between the phosphate coat deposited to improve the tribological properties and the oil film deposited to protect against corrosion.
- lack of stability in time of the tribological improvements imparted by deposition of a phosphate-based treatment product: as a result, it is more difficult to deep-draw sheets that have been kept in prolonged storage.

The object of the invention is to limit these disadvantages while providing a surface treatment that offers both good resistance to corrosion and good lubrication, even with a single oiling operation.

The object of the invention is a process for treatment of the metal surface of a sheet, especially a steel sheet, for the purpose of preparing the said sheet for deep-drawing and/or protecting it against corrosion, wherein an aqueous solution of treatment product is applied to the said surface, the said surface is dried, then at least one operation of oiling of the said surface is performed, characterized in that:

- the treatment product contains polyethoxylates of one or more lanolin derivatives, the said derivatives being sterols or fatty acid esters.
- the drying conditions are adjusted to obtain a deposit of treatment product in dry state on the said surface, the said deposit being considered to be in dry state if it is now free or almost free of water of composition,
- and at least one oiling operation is performed by applying a non-water-soluble oil on the said deposit while it is still in dry state.

Lanolin is a fatty substance of animal origin.

It is obtained, for example, by refining suintin; suintin itself is obtained by washing sheep's wool; suintin is usually considered to be a wax comprising mainly fatty alcohol esters which are of the cholesterol, isocholesterol, lanosterol type combined with saturated fatty acids having more than 23 carbon atoms.

For at least one oiling operation, non-water-soluble oil is understood as a homogeneous oil phase, which contrasts in particular to aqueous oil-in-water emulsions.

The invention may also have one or more of the following characteristics:

- the said lanolin derivatives are chosen from among fatty alcohols such as lanosterol, cholesterol, isocholesterol and fatty acids and esters derived from lanolin.
- if the said polyethoxylates have the general formula $D—O—(CH_2—CH_2—O)_n—H$, n is an integer between 30 and 150, preferably about 75, or n is chosen such that the said polyethoxylates have a hydrophilic-lipophilic balance (commonly called HLB) equal to at least 14 (on a scale of between 0.1 and 20).
- the said deposit in dry state has a surface density of between 100 and 400 mg/m$^2$ on the said surface.
- the said aqueous solution of treatment product contains at least one sequestering agent for iron ions.

The term "HLB" (hydrophilic-lipophilic balance) designates the ratio of hydrophobicity of the lipophilic portion of the polyethoxylate molecules to the hydrophilicity of the "ethoxy" solubilizing groups of the same molecules; the term is commonly used in the art of surfactants agents (see the treatise entitled "Techniques of the Engineer", Chapter A7610: "Surfactants").

Another object of the invention is a sheet, especially a steel sheet, treated according to the invention, characterized in that its metal surface is coated with two superposed and distinct layers, one being an intermediate layer containing the said treatment product and the other a superficial layer of oil.

The thickness of the said intermediate layer is preferably less than 1 $\mu$m and its surface density is higher than 100 mg/m$^2$.

A further object of the invention is a process for deep-drawing a metal sheet, especially of steel, wherein the said sheet is prepared by a process according to the invention, then the said sheet is formed by deep-drawing proper, characterized in that:

a single so-called oiling operation is performed before forming, the time interval between the said single oiling operation and the deep-drawing operation proper is longer than one day.

This time interval corresponds to a storage period during which the sheet treated according to the invention is effectively protected against corrosion by the double layer of treatment product and oil; it is this same double layer which serves to lubricate the interface between the sheet and deep-drawing die during the forming operation following the storage period.

The said time interval—or period of storage of the treated sheet—is preferably longer than one month.

BRIEF DESCRIPTION OF THE DRAWINGS

The invention will be better understood by reading the description given hereinafter by way of example and with reference to the attached figures, wherein.

Figure 1:
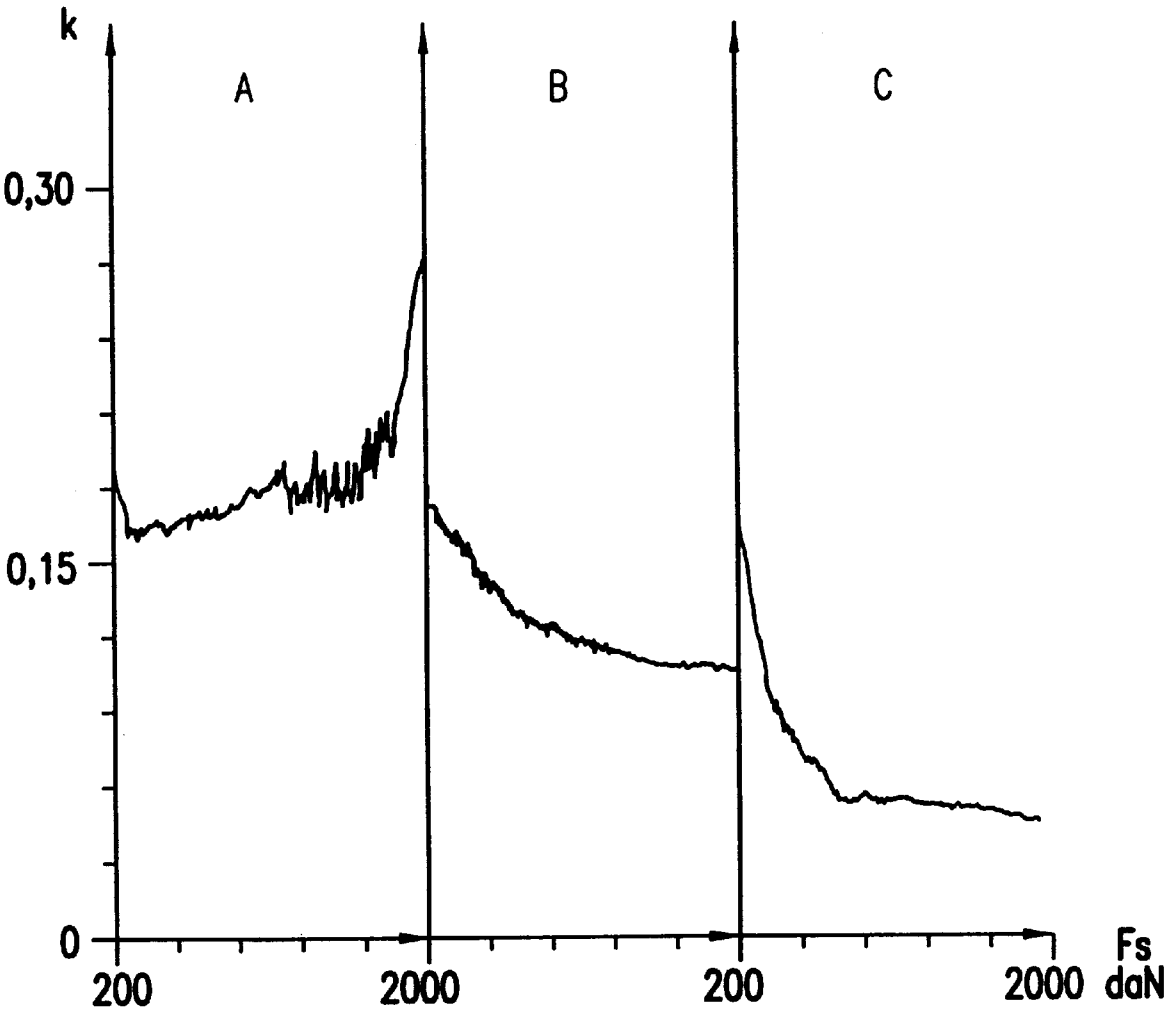
FIGS. 1 to 3 show curves A, B, C of tribological test results for different specimens; the ordinate represents the coefficient of friction k (from 0 to 0.3) and the abscissa represents, in FIGS. 1 and 3, the locking force $F_s$ (expressed in decanewtons or daN and ranging from 200 to 2000 daN in intervals of 360 daN) and, for FIG. 2, the friction distance D (expressed in mm and ranging from 0 to 180 mm).

A non-limitative example of the surface treatment process according to the invention will now be described for the case of application to a steel sheet.

An aqueous solution of treatment product is prepared by dissolving lanosterol polyethoxylate in water, the said polyethoxylate having the general formula D—O—($CH_2$13 $CH_2$—O)$_n$—H, where D—OH represents lanosterol.

Because it is polyethoxylated, the lanosterol is easy to dissolve in water.

According to other variants of the invention, there can be used sterol derivatives of lanolin other than lanosterol, especially cholesterol or isocholesterol, or the corresponding ester derivatives or mixtures of those derivatives.

The number of "ethylene oxide" radicals per molecule of polyethoxylate product is preferably between 30 and 150, especially on the order of 75.

The number of "ethylene oxide" radicals per molecule of polyethoxylate product is preferably adjusted so as to obtain a polyethoxylate having an HLB equal to at least 14 (hydrophilic-lipophilic balance, on a scale of 0.1 to 20).

According to an equivalent variant of the invention, "propylene oxide" radicals can be used instead of "ethylene oxide" radicals.

The concentration of polyethoxylates in solution, the conditions of application of the said solution to the sheet to be treated and the drying conditions are adjusted in a manner known in itself in order to obtain on the sheet a deposit with thickness of less than 1 $\mu$m.

The surface density of the deposit of treatment product is advantageously between 300 and 400 mg/m$^2$.

Advantageously, the treatment solution is easy to handle, apply and dry on the sheet, since it is an aqueous solution.

The concentration of polyethoxylates in the solution is preferably between 0.5 and 10% by weight.

Advantageously, the concentration of polyethoxylates in the treatment solution is about 4%.

Antioxidants, preservatives (or bactericides) and anti-frothing agents can also be added to the solutions as necessary, especially depending on the requirements for storage and application of these solutions, the proportions being adjusted in a manner known in itself and these additives not having a notable effect on the performances of the surface treatment according to the invention.

The next step is the surface treatment according to the invention:

the aqueous treatment solution is applied to the metal surface of the sheet to be treated, then the applied solution is dried, and thereafter a lubricating oil known in itself and suitable for deep-drawing is applied to the sheet.

A treated sheet is obtained, the treatment according to the invention comprising deposition of an intermediate layer of lanosterol ethoxylates and of a superficial layer of oil.

The aqueous solution can be applied by techniques such as immersion or spraying.

For example, the treatment solution can be applied directly at the discharge end of a pickling line, thus guaranteeing that the metal surface to be treated will be clean.

Hot air can be used to dry the sheet.

To achieve the purposes of the invention, it is important to apply the oil only on an appropriately dried deposit.

For example, the lanosterol ethoxylate deposit is considered to be in sufficiently dry state to perform oiling and achieve the purposes of the invention as soon as it no longer contains water of composition.

The lanosterol ethoxylates are extremely hygroscopic: if exposed to a humid atmosphere, they can take up as much as 100% of their weight of water within a fairly short period (about ten minutes).

This uptake of water corresponds to adsorbed water, in contrast to water of composition.

Thus, to employ the process according to the invention, drying must be performed in such a manner as to eliminate all (or almost all) of the water of composition (in other words the water introduced by the solution of treatment product), but not with sufficient severity to eliminate the adsorbed water.

In addition, it is necessary to use for the oiling operation a non-water-soluble lubricating oil, especially one that has not been solubilized or dispersed in water.

Following discharge from drying until application of the oil, the sheet is preferably maintained at a temperature of at least 45° C., thus making it easier to maintain the lanosterol ethoxylate deposit in dry state.

It is then observed that the sheet treated according to the invention (dry deposit of lanosterol ethoxylates+oiling) has much better tribological properties than a sheet simply oiled without preliminary surface treatment.

These tribological performances are superior to those of a sheet treated according to the prior art, in particular by deposition of phosphate, then identical oiling.

It is also observed that, if oiling is performed on a dry deposit of lanosterol ethoxylates that has adsorbed water, good tribological performances are also obtained.

In contrast, it is observed that, if the deposit of lanosterol ethoxylates is not sufficiently dried, such that water of composition remains in this deposit, such tribological properties are not obtained.

In addition, the sheet treated in this way (dry deposit of lanosterol ethoxylates +oiling) can be degreased as easily as a sheet treated according to the prior art (phosphate deposit+ oiling).

According to a variant concerning the operation of oiling in the process according to the invention, when the sheet must be stored for a prolonged period after deposition of lanosterol ethoxylates, a protective oil known in itself is applied to impart corrosion resistance.

The protective oils used in general are not water-soluble, and it is important, in the treatment according to the invention, to use precisely non-water-soluble oils, which rules out the use of oil-in-water emulsions.

It is then observed that the sheet treated according to the invention (deposit of lanosterol ethoxylates+oiling to protect against corrosion) is much more resistant to corrosion than a sheet treated by a phosphate solution and oiled in the same way.

The deposit of lanosterol ethoxylates according to the invention is therefore much more compatible with the protective oils than in the case of prior art treatments, especially phosphate-based.

Contrary to certain prior art treatments, the deposit of lanosterol ethoxylates according to the invention does not conflict with the protection imparted by the oil.

Finally, it is observed that sheets treated according to the invention (deposit of lanosterol ethoxylates+oiling to protect against corrosion), then stored, do not have to be re-oiled just before deep-drawing, even after a prolonged storage period: thus it is possible to perform only one oiling operation between discharge of the sheets from fabrication (for example, discharge from pickling) and forming thereof by deep-drawing, and the sheet is protected against corrosion in the time interval between the single oiling operation and the deep-drawing operation proper.

In the classical industrial operations, this time interval is generally longer than one day, and represents the intermediate storage period.

By virtue of the invention, therefore, it is possible to simplify and/or to limit the operations positioned between the fabrication and forming of sheets.

The tribological characteristics obtained on a sheet treated according to the invention, even oiled by a protective oil that is not very suitable for deep-drawing, are at least comparable to those obtained with a sheet oiled directly by an oil specially designed for deep-drawing ("high-performance" oil) without preliminary deposit of lanosterol ethoxylates.

It is also observed that the tribological characteristics obtained by virtue of the surface treatment according to the invention persist even after long storage periods, which can exceed one month, and this indicates that the treatment according to the invention is stable by comparison with the treatment using alkali phosphate solutions.

Without prejudging the mechanisms involved, the Applicant postulates that these results are achieved by virtue in particular of low solubility of the lanolin polyethoxylate derivatives in oils, combined with strong affinity of the said polyethoxylates for the metal surface of the sheet to be treated, especially a steel sheet.

To achieve the required performances (lubrication, anti-corrosion), it is therefore important that the lanosterol ethoxylate deposit not be able to dissolve in the oil applied thereon, and that therefore this oil not contain aqueous phase; in fact, the treatment according to the invention cannot be effective when aqueous lubricating solutions or dispersions are used, since the deposit of lanosterol ethoxylates then tends to be eliminated rapidly by dissolution.

The number of "ethylene oxide" radicals per molecule of polyethoxylate product is sufficiently high to prevent dissolution of the treatment product in the oil, but must be kept sufficiently low that the deposit in dry state does not become too hygroscopic.

It is also advisable to ensure that the lanosterol is not ethoxylated (too high number of "ethylene oxide" radicals) to the point that there is a risk of dissolution of the oil in an aqueous phase (which would correspond to an emulsifier function).

An additional advantage of the invention is that the products diluted in the treatment solution, or in other words the polyethoxylates of lanolin derivatives, do not pose any risk to the environment or human health.

By virtue in particular of the absence of risks of toxic emissions, the sheets treated according to the invention can be easily spot-welded.

It has been observed that, at the end of a prolonged storage period, the sheets treated according to the invention might tend to become slightly yellowed at the surface, especially if the intermediate dry deposit of ethoxylate contains adsorbed water.

The intermediate dry deposit of ethoxylate contains significant quantities of adsorbed water in particular if drying was not performed very intensively (limited simply to evaporation of the water of composition), or if the deposit was allowed to adsorb water before oiling (case in which the sheet was left to cool in a humid atmosphere before oiling).

Advantageously, in order to avoid this risk of yellowing, chelating or sequestering agents, especially for iron ions ($Fe^{2+}$, $Fe^{3+}$), are added to the solution of treatment product according to the invention.

The invention is also applicable to steel sheets coated with metal, such as galvanized sheets.

The invention also extends to cases in which a second oiling operation is performed at the end of the storage period and just before deep-drawing proper, especially for the purpose of further improving the tribological properties; the use of water-soluble oils must always be avoided in this case.

The invention also extends to cases in which at least one corrosion inhibitor is added to the solution of treatment product based on lanosterol ethoxylate, especially for the purpose of further improving the corrosion resistance imparted by the treatment according to the invention.

The invention will be illustrated by the following examples:

In these examples, unless otherwise mentioned, a solution of treatment product is applied to steel specimens, which are then dried in hot air to obtain a specimen coated with a dry deposit of treatment product, then a film of oil is applied to the dry deposit.

In the treatment solutions there is used as treatment product:

either lanosterol polyethoxylates having a mean number m of ethylene oxide radicals, as examples of the invention.

X designates the product for which m=75 as well as the associated surface treatment (application of the treatment solution+drying).

X' designates the product for which m=30 as well as the associated surface treatment (application+drying); the HLB index of the product X' is equal to about 14 on a scale of 0.1 to 20, where 0.1 corresponds to an extremely lipophilic product and 20 to an extremely hydrophilic product.

or potassium phosphate, designated by P, which also designates the associated surface treatment (application+drying), for comparison with the prior art.

Deposition of the treatment product is performed under the drying conditions mentioned hereinabove in the general description of the invention. In other words, drying is continued at least until all of the water of composition present in the layer of treatment solution applied on the specimen has been substantially evaporated.

The treatment product deposited in this way on the specimen before oiling represents a surface density on the order of 300 mg/m$^2$, which corresponds in any case to a thin film with a thickness of less than 1 $\mu$m.

Unless otherwise mentioned, the oil film applied to the dry deposit of treatment product corresponds to a surface density of about 2 g/m$^2$.

The following types of oil are used:

either a protective oil: type 80.21 oil of the QUAKER Co. is selected.

or a deep-drawing oil: type V14 oil of the FUCHS Co. is selected.

Oiling is preferably performed directly after drying, which prevents the deposit from adsorbing large quantities of water.

In the examples hereinafter, only a single oiling operation is performed before the tribological or deep-drawing tests.

EXAMPLE 1

The purpose of this example is to illustrate the improvement imparted by the surface treatment according to the invention to the coefficient of friction of the said surface.

Another purpose of this example is to illustrate that the tribological performances imparted by the treatment according to the invention do not depend on the oil type used (protective oil or deep-drawing oil).

The specimens used are of steel alloy BS2, which has a roughness of $R_a$=1.2 $\mu$m and dimensions of 2×40×500 mm.

After deposition of treatment product if applicable (phosphate: P—lanosterol ethoxylates: X), the specimens to be tested are oiled with a surface density of applied oil on the order of 2 g/m$^2$.

The tribological tests are performed in the following manner:

The test apparatus is a plane-to-plane tribometer of a type known in itself.

The specimens to be tested are clamped with a locking force $F_s$between two high-speed steel plates providing a bearing (or sliding) surface on the 1 cm$^2$ specimens.

The coefficient of friction k is measured by displacing the specimen relative to the plates over a total distance D of 180 mm at a speed of 2 mm/s by two procedures:

test (1): progressively increasing the locking force $F_s$.

test (2): maintaining the locking force constant at $F_s$=1800 daN.

Figure 2:
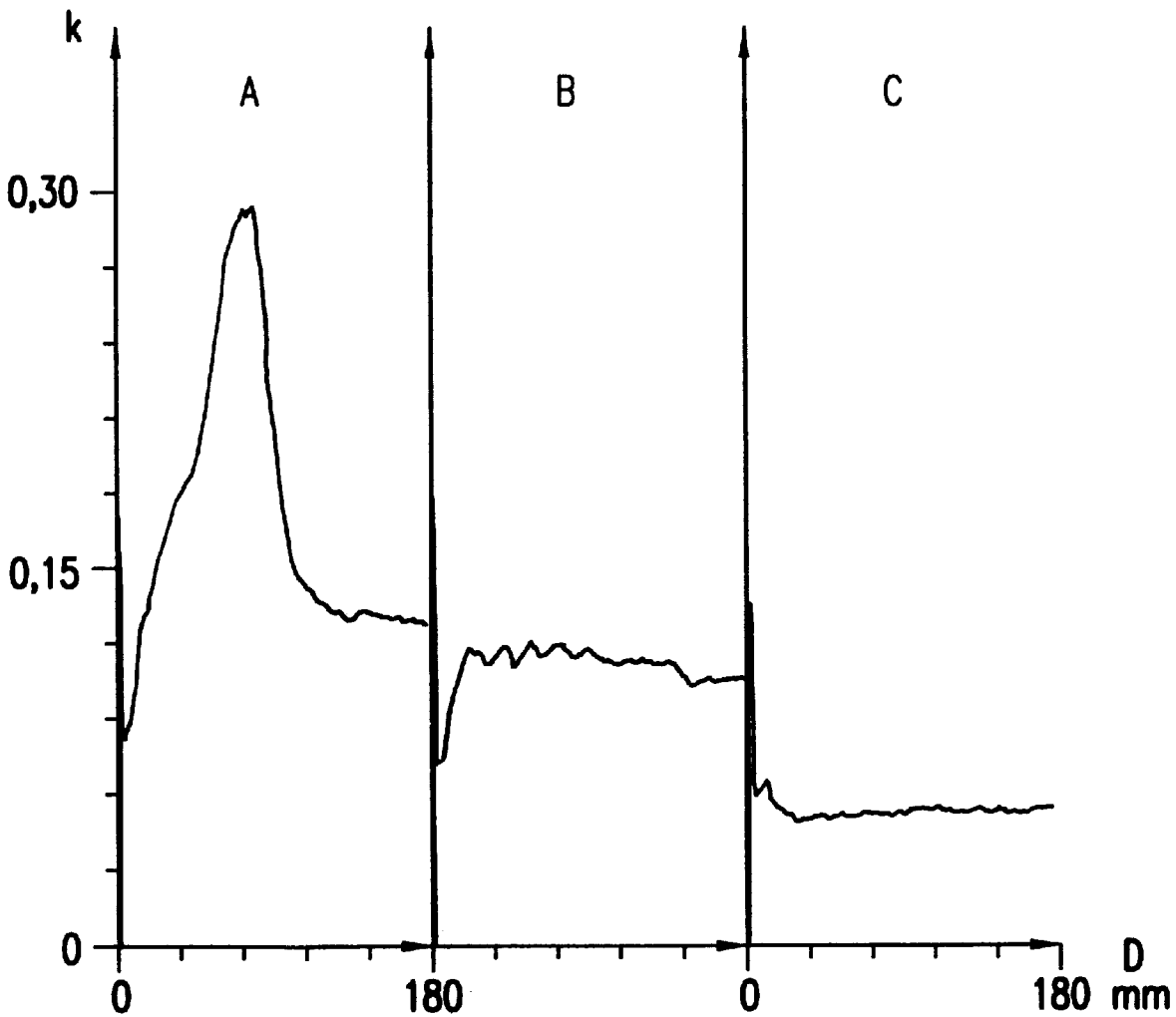
Figure 3:
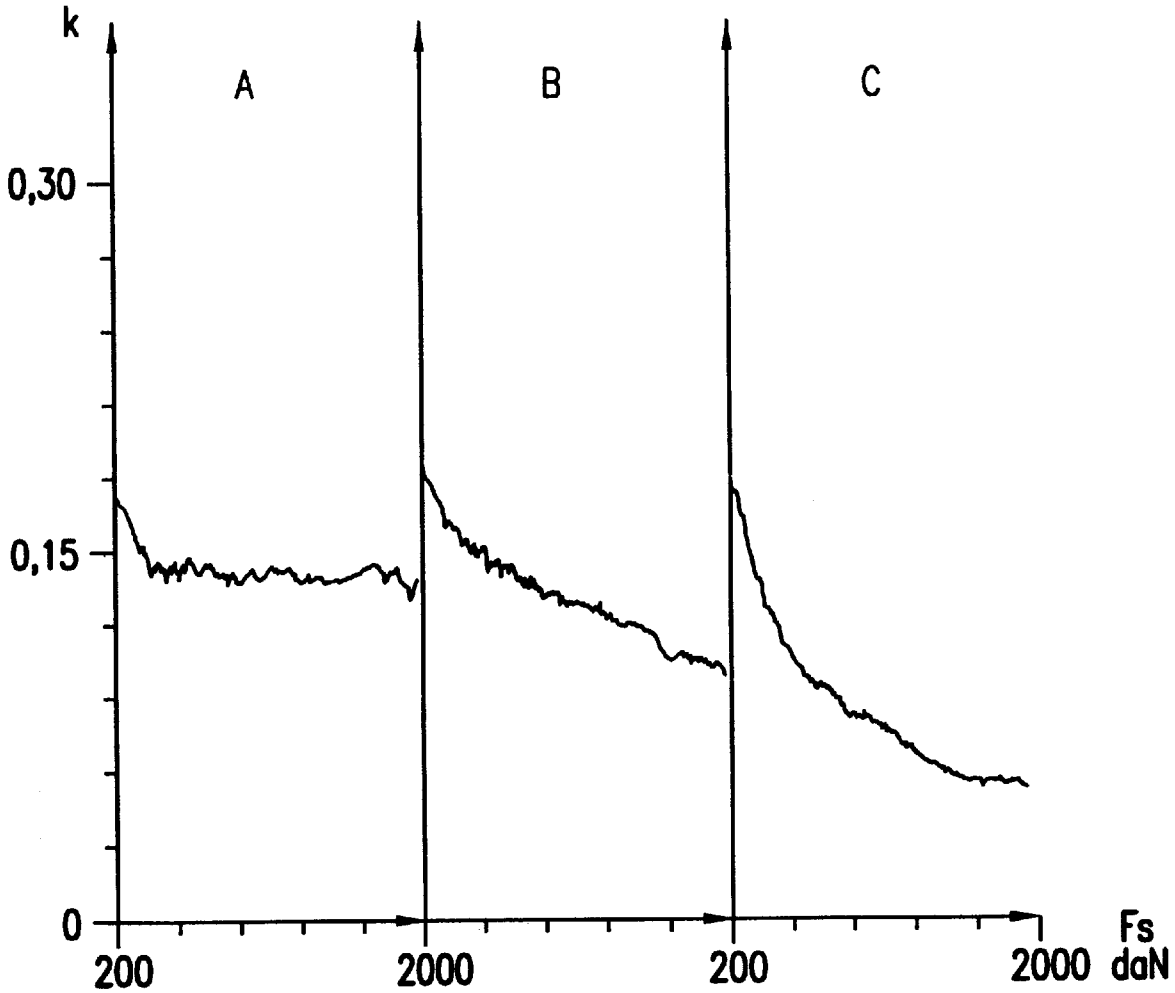

The results shown in FIGS. 1 to 3 were obtained for different surface treatments, different oils and different test procedures:

in each figure, A, B, C respectively designate the curves for an untreated specimen (A), a specimen with treatment P (B) and a specimen with treatment X according to the invention (C).

FIGS. 1 and 2 correspond to tests of samples oiled by means of a protective oil (QUAKER 80.21) and FIG. 3 to tests of samples oiled by means of a deep-drawing oil (FUCHS V14).

Values of the coefficient of friction for a locking force of 1800 daN are read from these curves and listed in Table I.

TABLE I

Comparative tribological tests.

| Variable (1) - constant (2) locking force | Preliminary deposit: | | |
|---|---|---|---|
| Coefficient of friction at $F_s$ = 1800 daN | none | P | X |
| Protective oil - test (1): FIG. 1 | 0.20 | 0.10 | 0.05 |
| Protective oil - test (2): FIG. 2 | 0.13* | 0.11 | 0.05 |
| Deep-drawing oil - test (1): FIG. 3 | 0.14 | 0.11 | 0.06 |

*the coefficient of friction peaks at 0.3 then stabilizes at 0.13.

The treatment according to the invention therefore imparts a very substantial improvement of the tribological properties, since the coefficient of friction of the metal of the specimens is approximately one half of that of the metal treated according to the prior art (deposition of phosphate+oiling) and one third of that of the directly oiled metal.

In addition, the coefficients of friction of specimens treated according to the invention are comparable whether a protective oil or a deep-drawing oil is used for the oiling operation, which shows that the tribological properties resulting from the treatment according to the invention are independent of the oil used.

Specimens treated according to the invention were also examined under the microscope to observe the surfaces after friction at different stages of the friction distance D—16, 69, 121, 174 mm—in the tribometer.

Particular note was made of the value of the distance D starting from which the development of score marks and then of bonding points was observed; the observations are listed in Table II.

TABLE II

| Observations of surfaces after friction. | | | |
|---|---|---|---|
| Tests at constant locking force (2)<br>Result: value of the distance D in mm . . . | Preliminary deposit: | | |
| . . . to development of the defect: | none | P | X |
| defect of score marks: | 69 | 69 | none |
| defect of bonding points: | 69 | 174 | none |

The microscopic observations therefore confirm the improvements imparted by the surface treatment according to the invention compared with the prior art treatments, since defects in the form of score marks or bonding points are not observed after a friction distance of 180 mm under a locking force of 1800 daN.

EXAMPLE 2

The purpose of this example is to illustrate a preferred embodiment of the invention, according to which the mean number m of ethylene oxide radicals in the molecule of the treatment product is between 30 and 150.

Tribological tests were performed according to the same procedure—test (1)—as in Example 1 (variable $F_s$) on two specimens with treatments X and X' according to the invention (with "protective" oiling: QUAKER 80.21).

Figure 5:
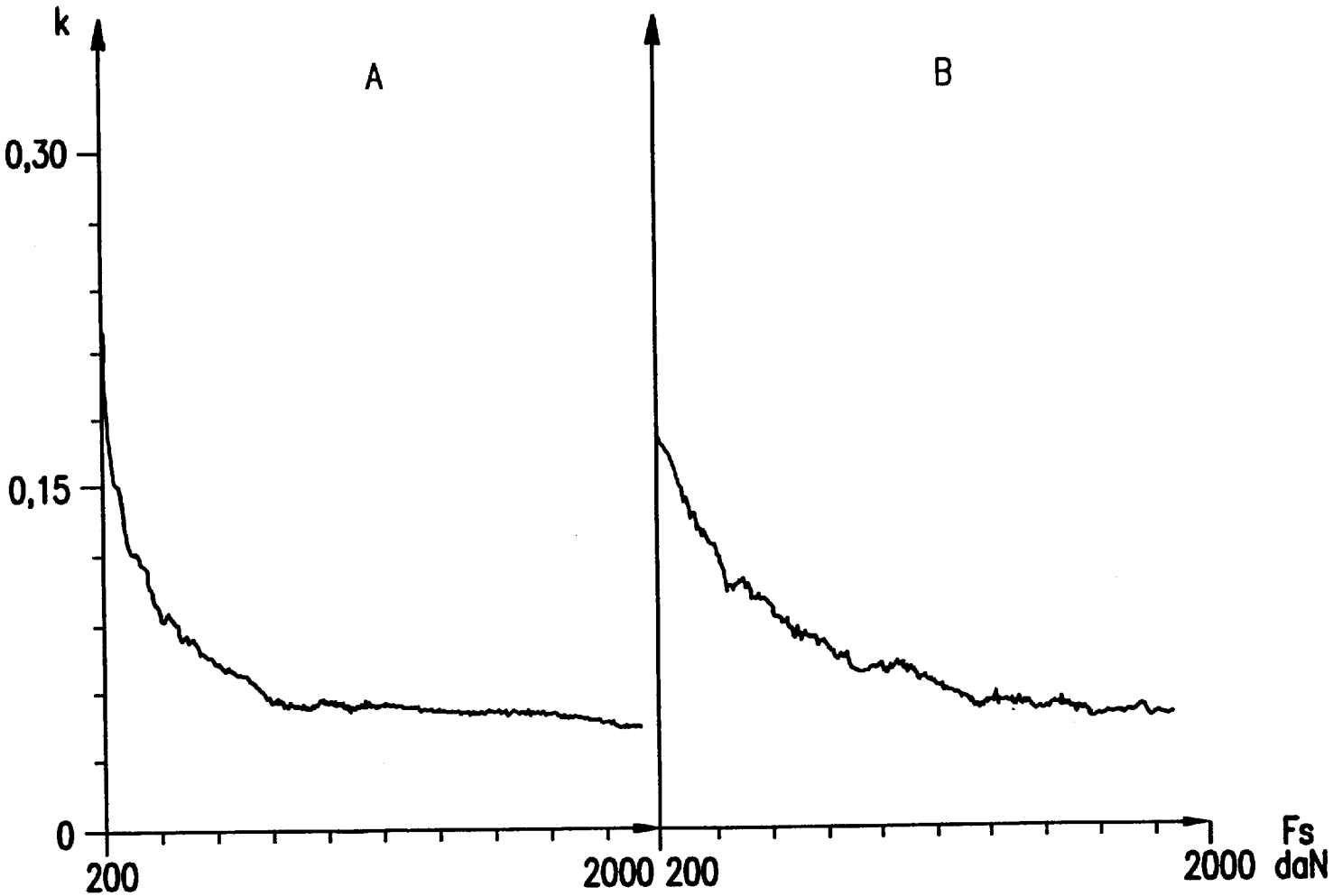

The corresponding results are shown in FIGS. 5-A (X) and 6-A (X') and summarized in Table III.

TABLE III

Figure 6:
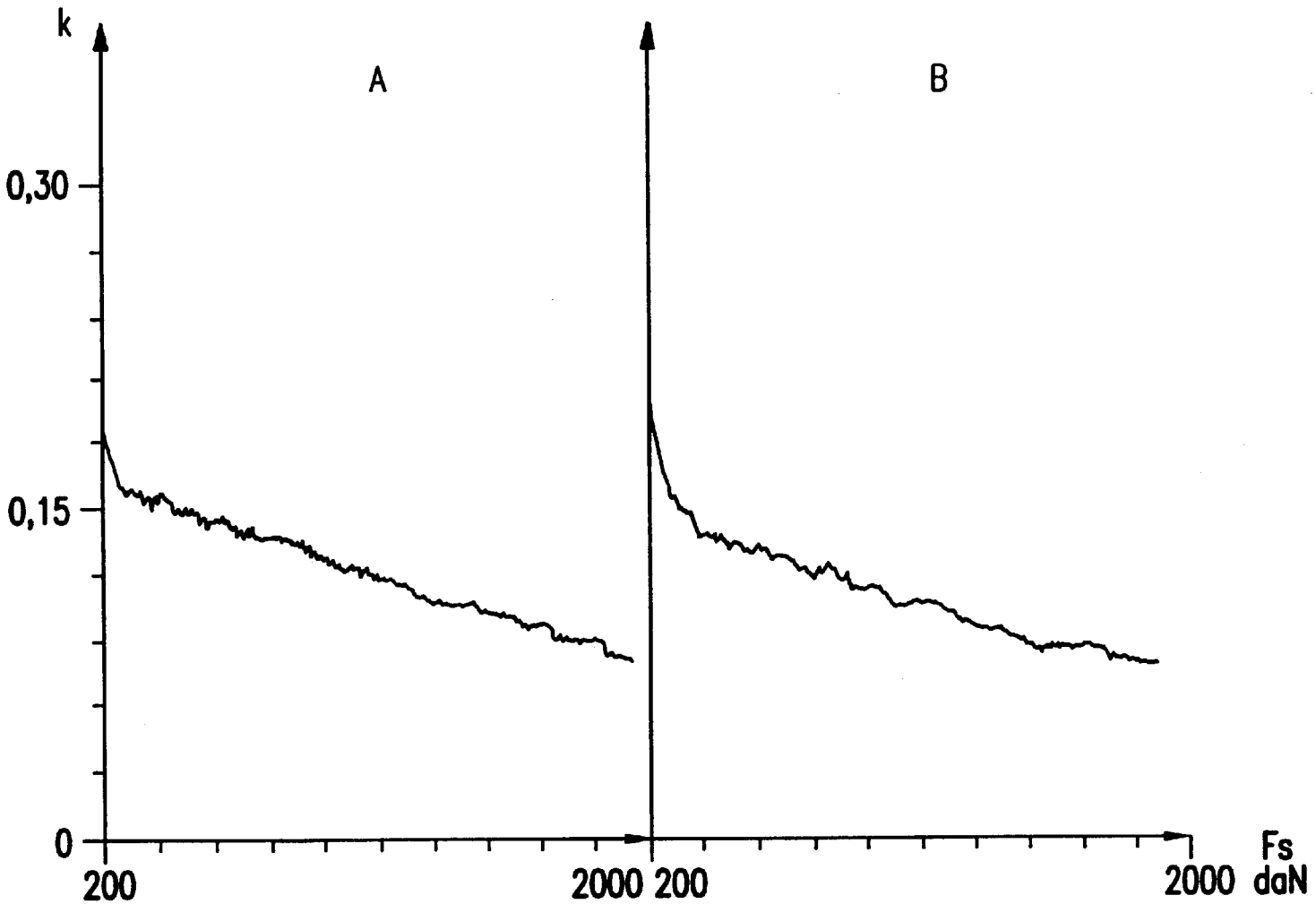

| Comparative tribological tests after treatments according to the invention. | | |
|---|---|---|
| Treatment product according to the invention: | X | X' |
| Mean ethylene oxide number/molecule | 75 | 30 |
| Test (1) - with variable locking force. | | |
| Protective oil - test (1) . . . according to the figure: | FIG. 5-A | FIG. 6-A |
| Coefficient of friction at $F_s$ = 1800 daN: | 0.05 | 0.09 |

It will be recalled that X and X' differ by the type of lanolin polyethoxylate derivative used: defining m as the mean number of ethylene oxide radicals per molecule, m=75 for X and m=30 for X'.

Thus the tribological properties obtained after treatment of the metal surface according to the invention depend on the mean number m of ethylene oxide radicals in the molecule of treatment product: the tribological performances are poorer when the value of m is too low, but are still superior to those corresponding to prior art treatments for a value of m on the order of 30.

EXAMPLE 3

The purpose of this example is to illustrate the stability of tribological performances imparted by the treatment according to the invention, even after several weeks of storage.

The same tribological measurements—test (1)—as in Example 1 (variable $F_s$) were performed, some immediately after the treatment and others 30 days after the treatment.

The treatments (deposition+oiling) were performed by using a protective oil (QUAKER 80.21).

Figure 4:
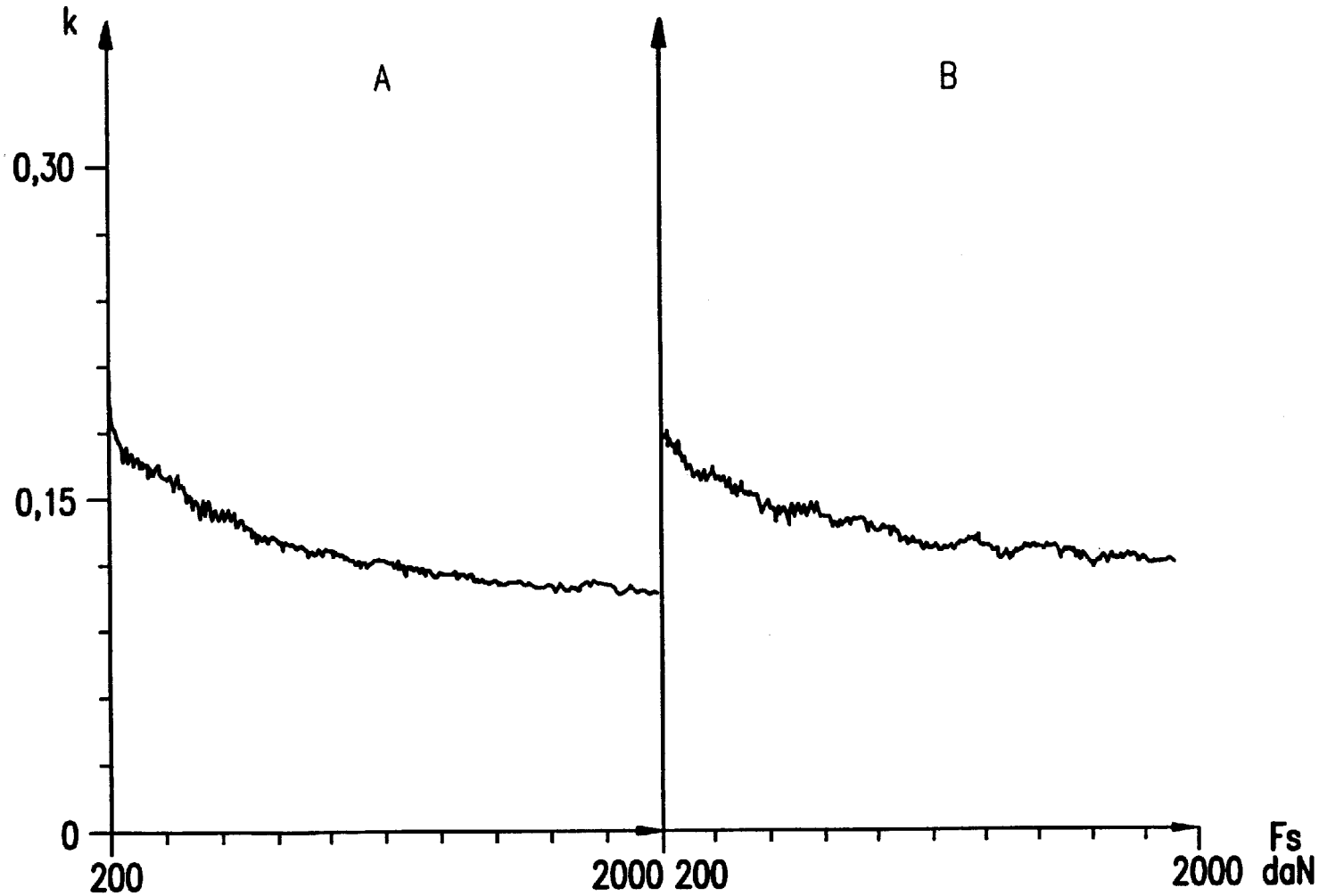
FIGS. 4, 5 and 6 show, for one type of specimen each, the results of tribological tests immediately after treatment (A) and 30 days after treatment (B); the ordinate represents the coefficient of friction k (from 0 to 0.3) and the abscissa represents the locking force $F_s$ (expressed in decanewtons or daN and ranging from 200 to 2000 daN).

The results are presented in FIGS. 4 to 6, for different surface treatments (FIG. 4: P; FIG. 5: X; FIG. 6: X'); on each figure, curves A represent the results of tests performed immediately after the treatment and curves B the results of tests performed 30 days after the treatment.

The results are also summarized in Table IV.

TABLE IV

| Tribological tests: stability of preliminary treatments. | | |
|---|---|---|
| Test (1) - with variable locking force<br>on oiled specimens (protective oil)<br>Coefficient of friction at $F_s$ = 1800 daN . . . | Test performed<br>x days after treatment: x: | |
| . . . depending on nature of the treatment | 0 days | 30 days |
| treatment P (prior art): | 0.11 | 0.12 |
| treatment X (invention): | 0.05 | 0.05 |
| treatment X' (invention): | 0.09 | 0.08 |

Thus the surface treatment according to the invention ensures that the improvement in tribological properties is more stable in time than in the prior art treatments.

EXAMPLE 4

The purpose of this example is to confirm, by deep-drawing tests, the results obtained from the tribological tests, especially those of Example 1.

To this end, tests of flat-bottomed "SWIFT" type, known in themselves, were performed on an ERICHSEN press.

The blanks of sheet to be drawn were of 3C steel alloy—which is an extra mild steel for deep-drawing—and had a thickness of 2 mm.

The characteristics of the deep-drawing machine were as follows: male punch diameter: 110 mm—blank diameter: 220 mm (β=2)—deep-drawing speed: 3 mm/s.

To characterize the reduction of friction during deep drawing, the "critical" locking force $F_{sr}$ of the blank holder at which breaking of the part first occurs during deep-drawing is measured: see results in Table V.

Several types of sheet blank were tested: untreated ("none"), treated per P and treated per X (defined in the preamble to the examples); the sheet blanks were all oiled in the same way with a protective oil.

TABLE V

| Maximum locking force during deep-drawing | | | |
|---|---|---|---|
| Nature of the treatment: | none | P | X |
| Critical locking force (kN) | 70 | 150 | 190 |

To supplement the results, sheet blanks deep-drawn with a locking force slightly lower than the critical locking force were observed: the surface condition of the sheet blank treated per X remained very good, whereas seizing on the skirt of the untreated sheet blank was observed.

These deep-drawing results therefore confirm the conclusions of the tribological tests of Example 1.

EXAMPLE 5

The purpose of this example is to illustrate the advantage imparted by the surface treatment according to the invention when it is desired simultaneously to improve the tribological properties and to protect the treated sheet against corrosion.

To illustrate this advantage, two types of corrosion test were performed on steel sheet specimens:

test (1) of atmospheric corrosion: the specimen was exposed to the atmosphere.

test (2) of corrosion in a climate chamber: the specimens in a clamped package were placed in the chamber to simulate the conditions to which a coiled sheet is subjected during a transportation operation.

The climatic cycle to which the package of specimens to be tested was subjected was as follows: 10 h at 40° C. and 95% relative humidity—4 h at 20° C. and 85% relative humidity—10 h at °50° C. and 0% relative humidity—8 h at 30° C. and 85% relative humidity.

The result of the test—(1) or (2)—was obtained by observing any traces of corrosion of the specimens—pits and/or spots—and by classifying the observations on a scale of 0 to 5:0 for absence of pits, 5 for generalized spots.

For a given type of specimen, the test results were recorded as a function of the number of days of exposure—test (1)—or of the number of climatic cycles—test (2).

Tests were performed on several types of specimens: oiled without preliminary deposition ("none"), treated according to the prior art (P), treated according to the invention (X).

The results obtained are presented in Tables VII (test 1) and VIII (test 2); Table V (test 1) shows by way of indication the results obtained on specimens treated under the same conditions but not oiled.

TABLE VI

Atmospheric corrosion tests (1) on non-oiled specimens.

| | Days: | |
|---|---|---|
| Deposit | 6 | 11 |
| none | 0.5 | 4.0 |
| P | 0.5 | 5.0 |
| X | 0.0 | 0.5 |

TABLE VII

Atmospheric corrosion tests (1) on oiled specimens (1 g/m$^2$).

| | Days: | | | | |
|---|---|---|---|---|---|
| Deposit | 6 | 11 | 14 | 19 | 29 |
| none | 0.0 | 0.0 | 0.0 | | |
| P | 0.0 | 2.0 | 2.5 | 3.0 | 4.0 |
| X | 0.0 | 0.5 | 0.5 | 0.5 | 1.0 |

TABLE VIII

Climatic corrosion tests (2) on oiled specimens 1 g/m$^2$.

| | Number of cycles: | | |
|---|---|---|---|
| Deposit | 3 | 5 | 7 |
| none | 0.5 | 0.5 | 1.0 |
| P | 1.0 | 2.5 | 3.0 |
| X | 0.5 | 1.0 | 2.0 |

It is therefore observed that the treatment according to the invention imparts better protection against corrosion than does a prior art treatment: a preliminary deposit of lanosterol ethoxylate degrades the corrosion resistance imparted by the oil layer less than does a deposit of potassium phosphate.

EXAMPLE 6

The purpose of this example is to demonstrate that sheets treated according to the invention are as easy to degrease as sheets treated according to the prior art (deposition of potassium phosphate+identical oil).

To evaluate the degreasability (in %), a procedure in conformity with French Standard NFT 60-159 is used.

The degreasability of oiled specimens is evaluated on the one hand directly and on the other hand after an "aging" treatment which comprises maintaining the specimen at 150° C. for 15 minutes.

The results are presented in Table IX.

TABLE IX

Degreasability tests

| Degreasability (%) of the sheet . . . | Test performed without/ with aging: | |
|---|---|---|
| . . . after deposition (or not) and oiling. | without | with |
| direct oiling: | 100% | 100% |
| treatment P (prior art): | 100% | 100% |
| treatment X (invention): | 100% | 95% |

Thus, even after a sheet has been treated according to the invention, it can be easily degreased to restore the surface of the sheet to "bare" condition.

EXAMPLE 7

The purpose of this example is to illustrate the improvement of the tribological properties achieved by means of the treatment according to the invention applied to coated steel sheets.

Another purpose of this example is to illustrate how the ethoxylate concentration in the treatment solution according to the invention affects the improvement of the tribological properties.

Finally, a purpose of this example is to illustrate the tribological performances obtained on a surface treated by a lanosterol ethoxylate solution and then dried but not oiled.

The example in question here relates to electrogalvanized steel sheets.

Four types of specimens were prepared according to the following procedures:

| Procedure | Deposit: ethoxylate concentration in the treatment solution. | Oiling after deposition (QUAKER 6130 oil) |
|---|---|---|
| A | No preliminary deposit. | yes |
| B | 4% by weight. | yes |
| C | 10% by weight. | yes |
| D | 10% by weight. | NO |

Figure 7:
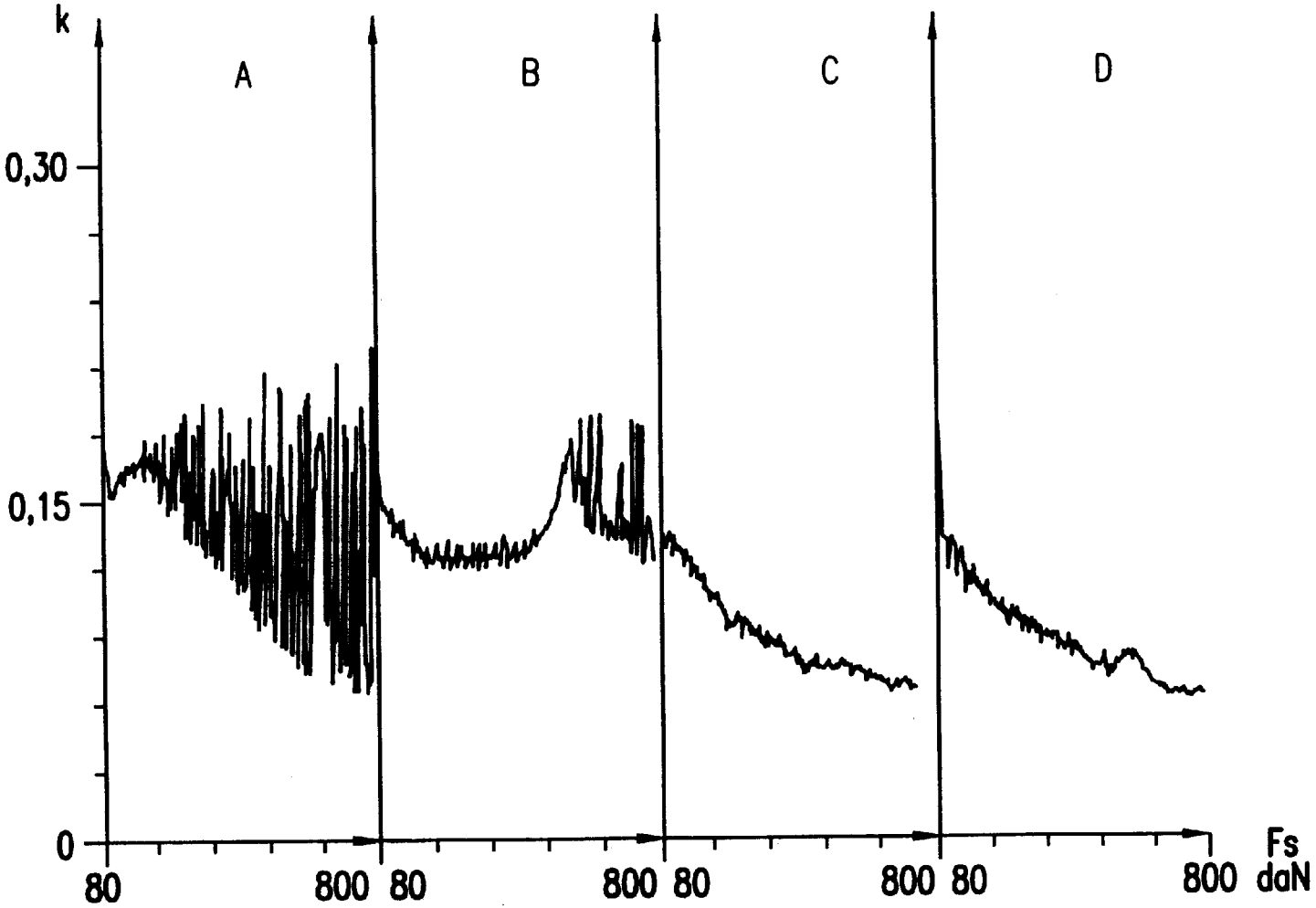
FIG. 7 shows the results of tribological tests on galvanized steel specimens treated under different conditions (curves A to D); the ordinate represents the coefficient of friction k (from 0 to 0.3) and the abscissa represents the locking force $F_s$ (expressed in decanewtons or daN and ranging from 80 to 800 daN in intervals of 144 daN).

Curves A, B, C and D of FIG. 7 correspond to the results of tribological tests for specimens of type A, B, C and D respectively.

The tests were performed according to procedure (1) of Example 1 (variable $F_s$), with the difference that the locking force was kept in the range of 80 to 800 daN.

Comparison of curves A and B shows the improvement of the tribological properties imparted by the treatment according to the invention applied to galvanized steel surfaces. This improvement is evident mainly in terms of regularity of slipping.

Comparison of curves B and C shows that the improvement of the tribological properties is more accentuated when treatments with higher concentrations of ethoxylates of lanolin derivatives are used.

Curve D shows that good tribological properties are also obtained even if oiling is not performed after deposition of ethoxylate.

EXAMPLE 8

The purpose of this example is to illustrate how the surface density of dry deposit of lanosterol ethoxylate according to the invention affects the tribological properties.

Starting with BS2 steel alloy, four types of specimens A, B, C, D treated according to the invention were prepared: lanosterol ethoxylate deposit+oiling with QUAKER 80.21, the types of specimens being differentiated by the different surface density of the lanosterol ethoxylate deposit.

The tribological performances were measured according to the procedure of test (1).

Figure 8:
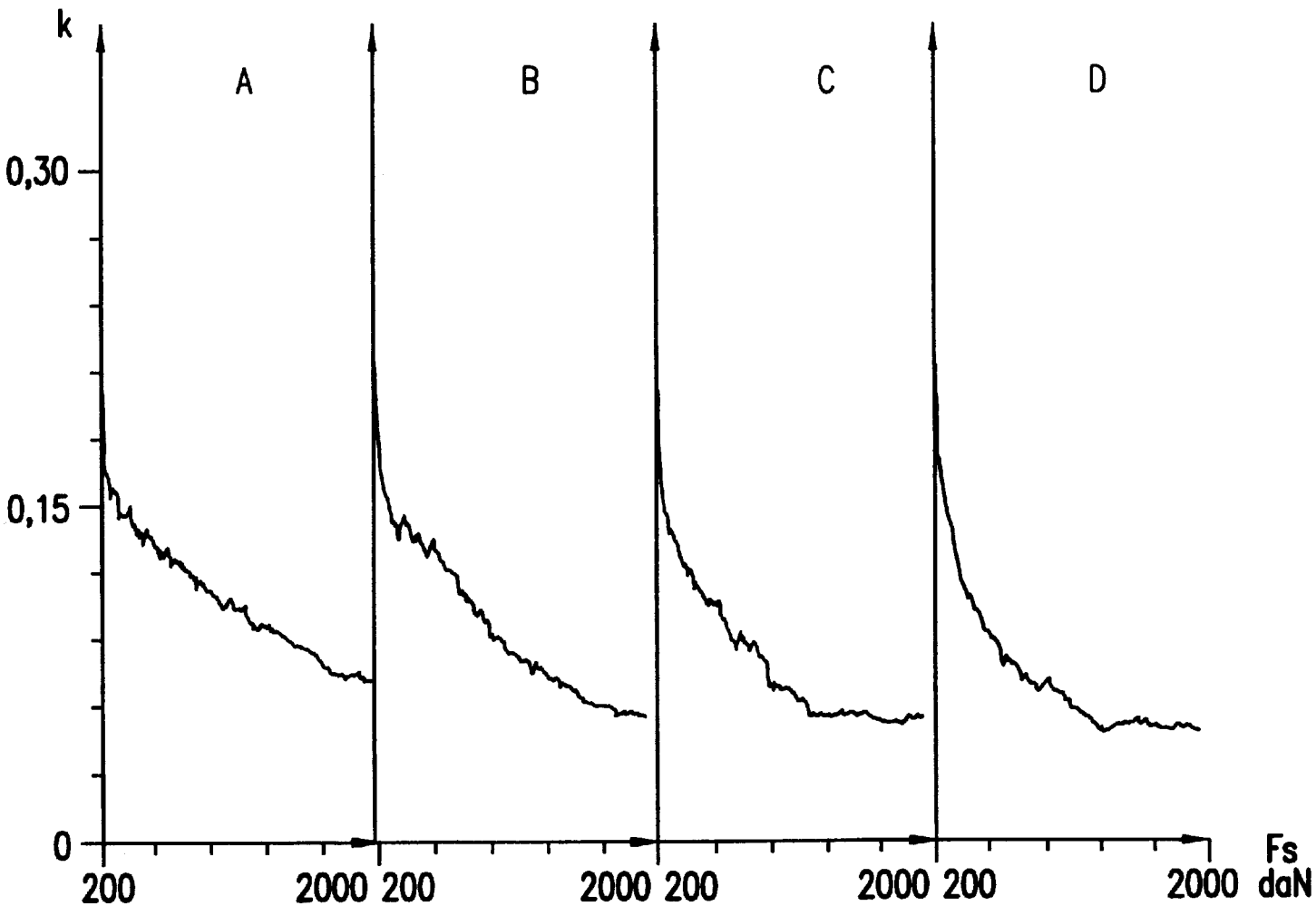
FIG. 8 shows the results of tribological tests on steel specimens treated according to the invention for different surface densities of the preliminary ethoxylate deposit (curves A to D); the ordinate represents the coefficient of friction k (from 0 to 0.3) and the abscissa represents the locking force $F_s$ (expressed in decanewtons or daN and ranging from 200 to 2000 daN).

The results obtained are presented in FIG. 8 and in Table X.

TABLE X

Influence of the density of preliminary deposit.

| Procedure | Deposit: Ianosterol ethoxylate Surface density | Coefficient of friction k at $F_s$ = 1800 daN |
|---|---|---|
| A | 300 mg/m$^2$ | 0.075 |
| B | 380 mg/m$^2$ | 0.055 |
| C | 470 mg/m$^2$ | 0.050 |
| D | 660 mg/m$^2$ | 0.045 |

Curves A, B, C and D of FIG. 8 correspond to the results of tribological tests for the specimens of type A, B, C and D respectively.

It is therefore observed that a substantial improvement of the tribological properties is obtained as soon as the density of deposition reaches 300 mg/m$^2$ and that this improvement does not become substantially more accentuated beyond approximately 400 mg/m$^2$.

EXAMPLE 9

The purpose of this example is to illustrate how the addition of sequestering agent (for iron ions) to the solution of treatment product according to the invention affects the suppression of the risks of yellowing of sheets treated according to the invention.

The trisodium salt of hydroxyethylethylenediamineacetic acid (HEDTA $Na_3$) was used as the sequestering agent here.

Specimens were prepared according to the procedure defined in the preamble to the examples, except that this sequestering agent was added in different concentrations to the solution of treatment product.

The specimens treated according to the invention were then exposed to sunlight for the same period, at the end of which their yellowing or "yellowness index" was measured by a colorimetric method known in itself.

The yellowness index, designated by B*, was subtracted from the trichromatic coordinates measured on the CIE-LAB colorimetric scale by means of an LMG 083 calorimeter of the "Microcolor Docteur Lange" Company.

The extreme values measured here range from almost 0 (no yellowing) to 8 (severe yellowing).

The results obtained are presented in Table XI.

TABLE XI

Effect of sequestering agent in preventing yellowing

| HEDTA $Na_3$ concentration (% by weight) in the treatment solution: | No deposit Direct oiling | 0% | 1% | 2% | 3% | 4% |
|---|---|---|---|---|---|---|
| Yellowness index B*: | 0.02 | 8 | 3 | 1.2 | 0.03 | 0.02 |

It is therefore observed that the introduction of sequestering agent to the solution of treatment product makes it possible to avoid the risks of yellowing of sheets treated according to the invention.

EXAMPLE 10

The purpose of this example is to illustrate the importance of drying (after application of the solution of treatment product) to obtain good tribological properties.

Two samples S1, S2, treated under condition X of the invention (defined hereinabove), oiled in the same way, were prepared.

The only difference between samples S1 and S2 is that, after application of the solution of product X:

S1 was dried for only 2 minutes at room temperature, to the point that the deposit (of treatment product—not dry) represented 1.2 g/m$^2$.

S2 was dried for 12 minutes at room temperature, to the point that the deposit (of treatment product—dry) represented 0.8 g/m$^2$.

Figure 9:
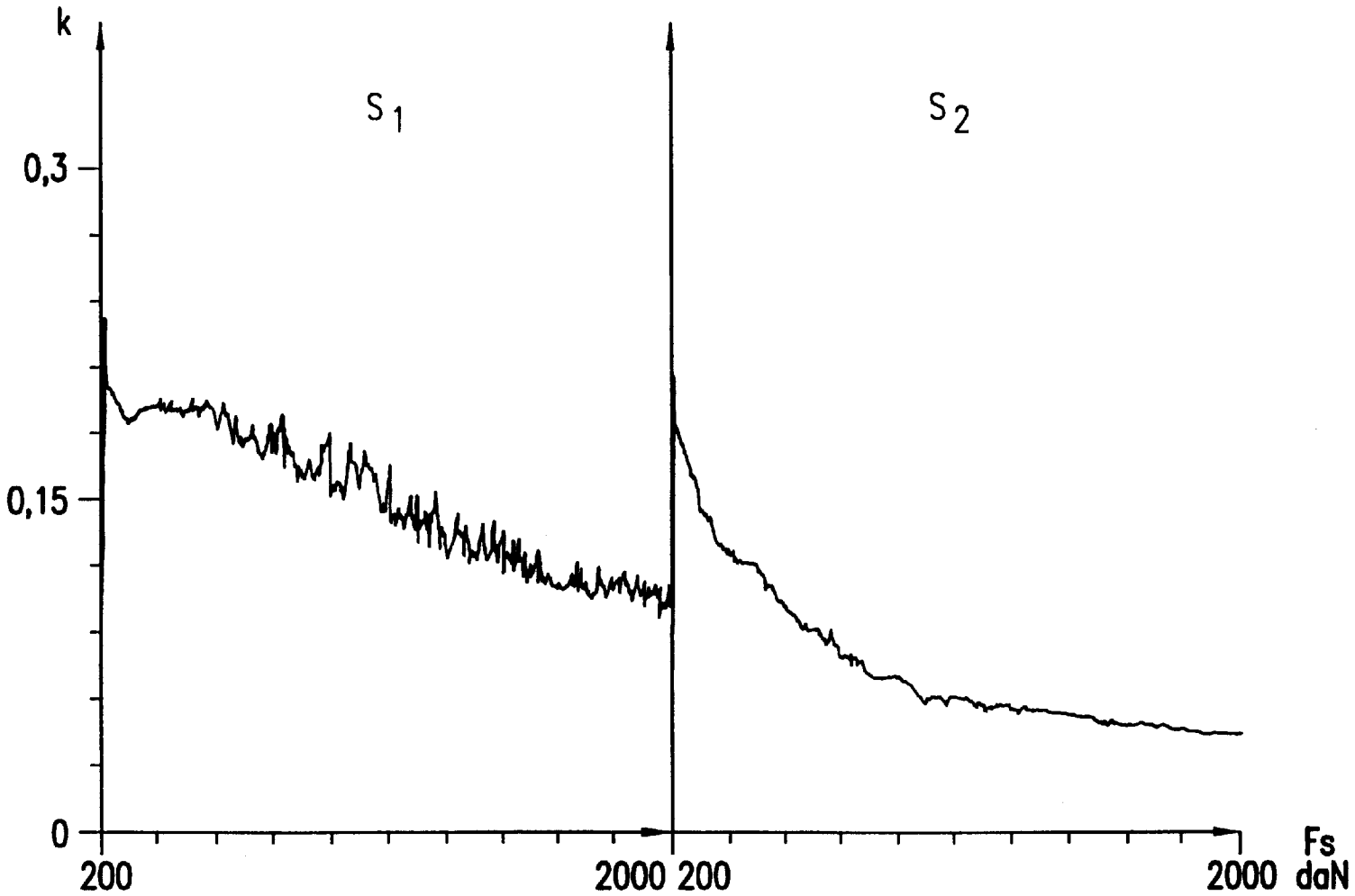
FIG. 9 shows the results of tribological tests according to the same conventions as for FIG. 8; curve S1 on a specimen whose preliminary deposit was not dried according to the invention, and curve S2 on a specimen whose preliminary deposit was dried according to the invention.

The tribological measurements made according to test (1) are presented in FIG. 9 and summarized as follows in terms of the value of the coefficient of friction k for a locking force $F_s$ of 1800 daN:

for S1 (not dried): k=0.11 for S2 (dried according to the invention): k=0.05

This example therefore clearly illustrates the importance of drying of the deposit of treatment product before oiling in order to obtain high-quality tribological performances.

We claim:

1. A process for treating a metal sheet surface, comprising: applying to the metal sheet surface a treatment product containing polyethoxylates of at least one lanolin derivative, said at least one lanolin derivative being a sterol or a fatty acid ester;

drying the metal sheet surface; and applying a non-water-soluble oil on to the metal sheet surface.

2. The process of claim 1, wherein said at least one lanolin derivative is selected from the group consisting of lanosterol, cholesterol, isocholesterol, fatty acids derived from lanolin and esters derived from lanolin.

3. The process of claim 1 or 2, wherein said polyethoxylates have a general formula D—O—$(CH_2—CH_2—)_n$—H, wherein $30 \leqq n \leqq 150$, and D—O—H is lanosterol.

4. The process of claim 1 or 2, wherein said polyethoxylates have a general formula D—O—$(CH_2—CH_2—O)_n$—H, wherein n is chosen such that said polyethoxylates have a hydrophilic-lipophilic balance equal to at least 14 on a scale of between 0.1 and 20, D—O—H is lanosterol.

5. The process of claim 1 or 2, wherein said treatment product deposited on the metal sheet surface has a surface density of between 100 and 400 $mg/m^2$ after said drying.

6. The process of claim 1 or 2, wherein said treatment product further contains at least one sequestering agent for iron ions.

7. A metal sheet treated according to claim 1 or 2, wherein said treatment product forms a layer between said metal surface and a layer of said non-water-soluble oil.

8. A metal sheet treated according to claim 7, wherein said layer of the treatment product has a thickness of less than 1 $\mu m$ and a surface density of greater than 100 $mg/m^2$.

9. The process of claim 1 or 2, further comprising:

forming said metal sheet by deep-drawing, wherein a time interval between said applying said non-water-soluble oil and said forming is longer than one day.

10. The process of claim 9, wherein said time interval is longer than one month.

11. A metal sheet treated by the process of claim 1.

12. A metal sheet treated by the process of claim 2.

13. A metal sheet treated by the process of claim 3.

14. A process for treating a metal sheet surface, comprising:

applying to said metal sheet surface a treatment product containing polyethoxylates of at least one lanolin derivative, said at least one lanolin derivative being a sterol or an ester from a fatty acid.

15. The process of claim 14, further comprising:

drying said metal sheet surface.

16. A metal sheet treated by the process of claim 14.

17. A metal sheet treated by the process of claim 15.

* * * * *